US006213297B1

(12) United States Patent
Gale

(10) Patent No.: US 6,213,297 B1
(45) Date of Patent: Apr. 10, 2001

(54) PACKAGING FOR BOTTLES AND BOTTLE NECK SHROUD FOR USE THEREWITH

(75) Inventor: Gregory W. Gale, Napa, CA (US)

(73) Assignee: Regale, Corporation, Napa, CA (US)

( * ) Notice: Subject to any disclaimer, the term of this patent is extended or adjusted under 35 U.S.C. 154(b) by 0 days.

(21) Appl. No.: 09/385,912

(22) Filed: Aug. 30, 1999

(51) Int. Cl.[7] ..... B65D 71/00
(52) U.S. Cl. ..... 206/427; 206/433
(58) Field of Search ..... 206/139, 158, 206/427, 433, 145, 151, 199, 201, 203; 294/87.2; 220/509, 513, 515, 516, 517, 518

(56) References Cited

U.S. PATENT DOCUMENTS

| | | | | |
|---|---|---|---|---|
| 3,912,075 | * | 10/1975 | Berry | 206/427 |
| 4,235,468 | * | 11/1980 | Erickson | 206/158 |
| 4,360,231 | * | 11/1982 | Bolin | 206/158 |
| 4,625,908 | * | 12/1986 | Emery | 206/427 |
| 4,634,002 | * | 1/1987 | Delonghi | 206/427 |
| 4,911,300 | * | 3/1990 | Colonna | 206/427 |
| 5,377,862 | * | 1/1995 | Oakes et al. | 206/433 |
| 5,975,300 | * | 11/1999 | Gale | 206/433 |

* cited by examiner

*Primary Examiner*—Luan K. Bui
(74) *Attorney, Agent, or Firm*—Flehr Hohbach Test Albritton & Herbert LLP

(57) ABSTRACT

Packaging for a plurality of juxtaposed bottles with the bottles being of a type having a base, a body adjoining the base, the body having a shoulder and an upstanding neck adjoining the shoulder and a label adhered to the body of the bottle below the shoulder and above the base. The packaging comprises a case in the form of a parallelepiped having spaced parallel side walls and spaced parallel end walls adjoining the side walls at right angles thereto and spaced-apart top and bottom closures adjoining the side and end walls at right angles thereto. A bottom insert is disposed in the bottom of the case and has a plurality of spaced-apart wells therein for receiving the bases of the plurality of juxtaposed bottles for retaining the bases of the juxtaposed bottles in spaced-apart positions. A shroud in the case engages the shoulders of the bottles for retaining the bottles in spaced-apart positions with respect to each other to prevent the labels of the bottles from coming into contact with each other and with the side and end walls of the case. The shroud comprises a plurality of shoulder-engaging members formed integral with each other and extending over the shoulders of the bottles to retain the shoulders of the bottles in spaced-apart position with respect to each other and the side and end walls of the case and retain the shoulder-engaging members in positions spaced above the labels of the bottles.

15 Claims, 4 Drawing Sheets

PACKAGING FOR BOTTLES AND BOTTLE NECK SHROUD FOR USE THEREWITH

This invention relates to packaging for bottles and a bottle neck shroud for use therewith.

Packaging has heretofore been provided for packaging of bottles including wine bottles. However, in such packaging it has been found that label scuffing occurs which seriously affects the appearance of the bottle and thereby greatly affects resale value. There is therefore a need for new and improved packaging which prevents such scuffing.

In general, it is an object of the present invention to provide packaging for bottles and a bottle neck shroud for use therewith which inhibits label scuffing.

Another object of the invention is to provide packaging and a shroud for use therewith which will also prevent scuffing of foil closures used on bottles.

Another object of the invention is to provide packaging and a shroud for use therewith which can be economically manufactured.

Another object of the invention is to provide packaging and a shroud for use therewith which can be utilized in conjunction with conventional packaging machinery.

Additional objects and features of the invention will appear from the following description in which the preferred embodiments are set forth in detail in conjunction with the accompanying drawings.

In general, the packaging for bottles incorporating the present invention is comprised of a case in the form of a parallelepiped containing a plurality of juxtaposed bottles packaged in the case. The bottles are of a type having a base, a body having an external surface adjoining the base with the body having a shoulder. A neck adjoins the shoulder. A label is adhered to the exterior of the body of the bottle below the shoulder. The packaging also includes a shroud having a plurality of shoulder-engaging members extending over the necks of the juxtaposed bottles and over the shoulders of the bottles. The shroud also includes means interconnecting the shoulder-engaging members for retaining the shoulder-engaging members in spaced apart positions to thereby prevent adjacent bottles from coming into contact with each other and to thereby prevent scuffing of the labels on the bottles.

Figure 1:
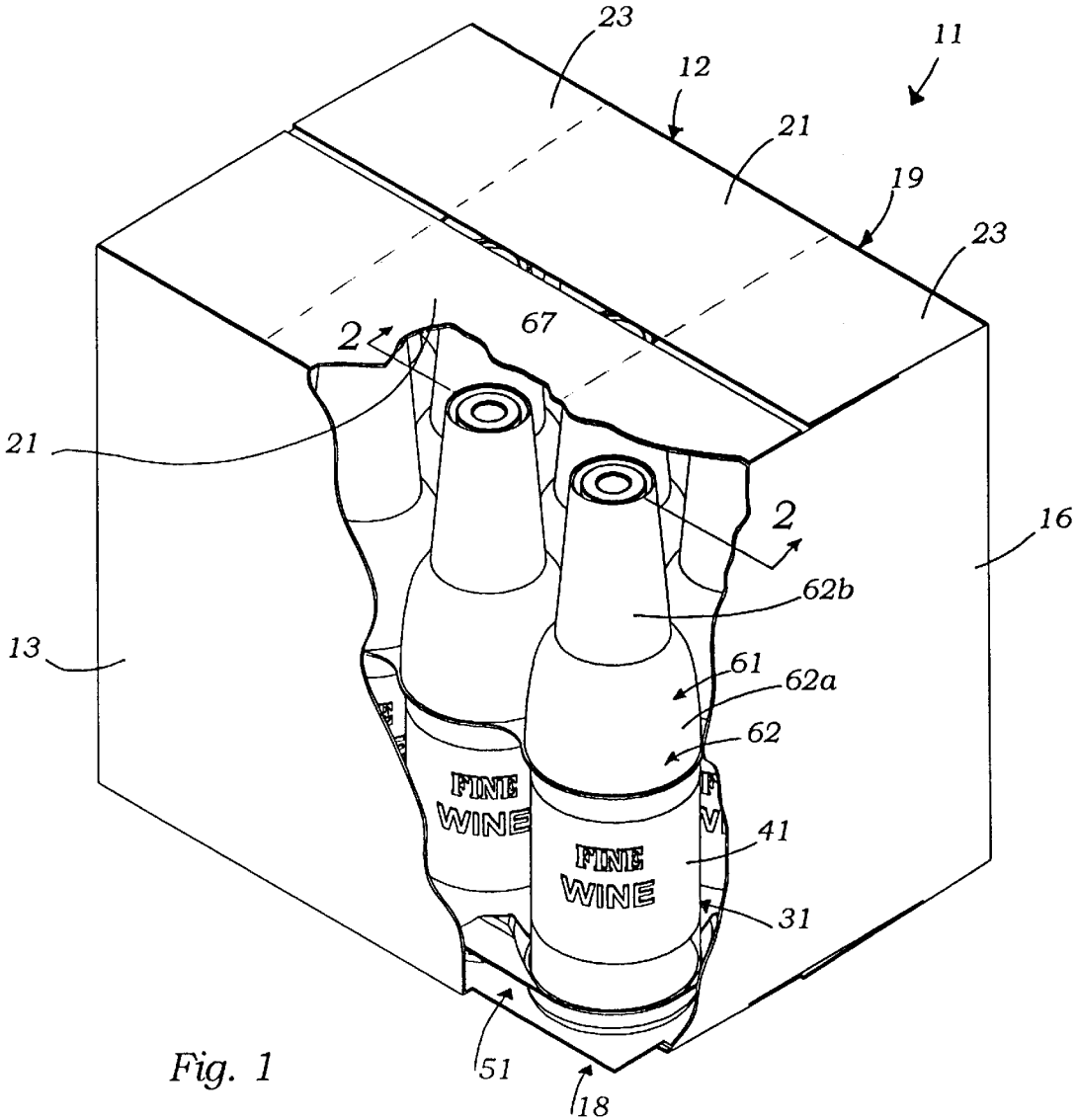
FIG. 1 is an isometric view, showing the packaging with certain portions broken away for bottles incorporating the present invention and showing a bottle-neck shroud for use therewith.

More in particular as shown in the drawings, the packaging 11 consists of a case 12 in the form of a parallelepiped having parallel spaced-apart side walls 13 and parallel spaced-apart end walls 16 adjoining the side walls 13 at right angles thereto. The case also includes bottom and top closures or walls 18 and 19 which extend at right angles to the side walls 13 and the end walls 16. The bottom and top closures or walls 18 and 19 are formed by major flaps 21 adjoining the side walls 13 and minor flaps 23 adjoining the end walls 16. The case thus far described is of a conventional type and as well known to those skilled in the art, the major flaps 21 and the minor flaps 23 as shown in FIG. 1 are folded to form the bottom and top closures or walls 18 and 19. The flaps are retained in the desired positions by the use of a suitable means such as an adhesive (not shown).

A plurality of bottles 31 are placed in juxtaposed positions within the case. The bottles are of a type having a base 32 and a body 33 adjoining the base. The body has a shoulder 34 at its upper extremity. A bottle neck 36 adjoins the shoulder 34. The bottles 31 can contain a suitable liquid as for example wine 37 and the wine is sealed therein in a suitable manner such as by a cork 38. The base 32 of the bottle can be provided with a punt 39. With such a punt, the bottle 31 can be in the form of a champagne bottle which as well known to those skilled in the art can be provided with a cork which is retained by a wire cage on the neck of the bottle and which typically is covered with a foil (not shown). Each of the bottles 31 is provided with a label 41 which is adhered to the body of the bottle exterior of the bottle generally below the shoulder 34 and extends circumferentially around at least a portion of the bottle.

A bottom platform or insert 51 is provided in the case 12 and can be formed of a suitable material such as molded pulp. The bottom insert is provided with a plurality of spaced-apart wells 52 that are sized to receive the bases 32 of the bottles 31 as shown particularly in FIGS. 1 and 2 to retain the bases of the bottles in juxtaposed but spaced apart positions. The wells 52 are provided with centrally disposed indentations 53 that are centrally disposed within the punts 39 of the bottles 31 and aid in positioning of the bases 32 of the bottles 31 in their spaced-apart positions.

Figure 2:
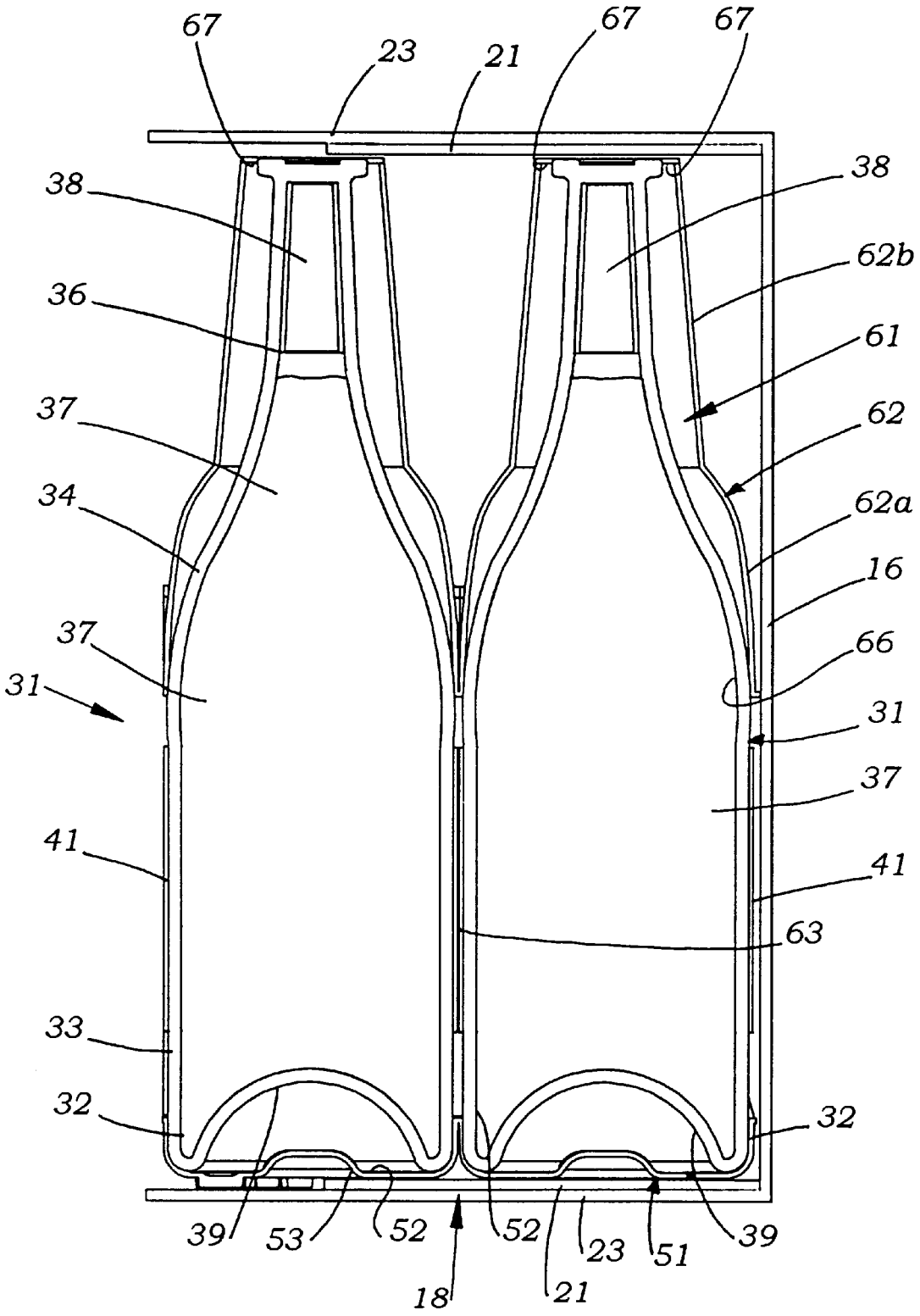
FIG. 2 is a cross-sectional view taken along the line 2—2 of FIG. 1.
Figure 3:
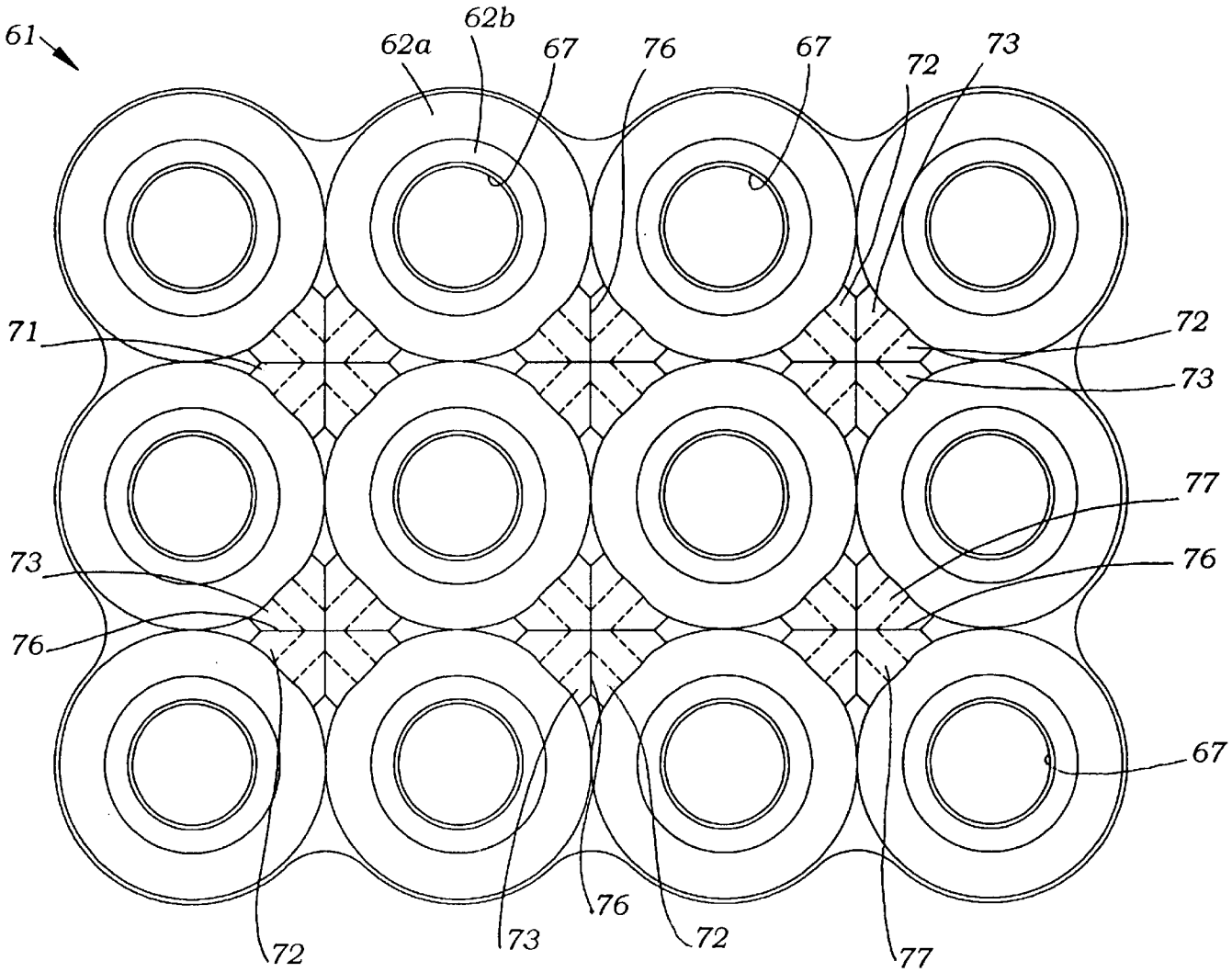
FIG. 3 is a top plan view of the bottle-neck shroud shown in FIG. 1.
Figure 4:
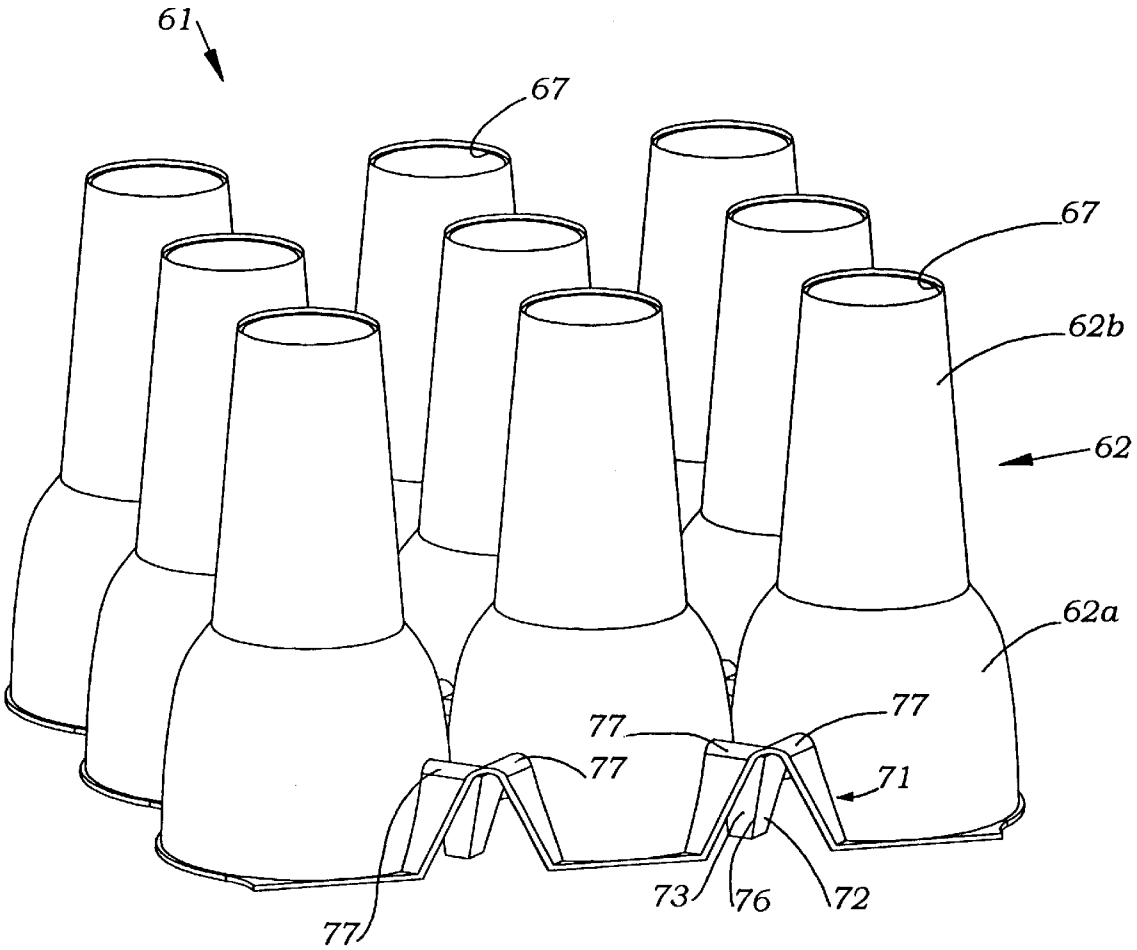
FIG. 4 is an isometric view shown in FIG. 3.

A shroud 61 is provided in the case 12 which can be characterized as a bottle neck and shoulder shroud. It is formed of a suitable material such as molded pulp. The shroud 61 consists of a plurality of juxtaposed shoulder-engaging members 62 that are adapted to extend downwardly over the shoulders 34 of the bottles but above and clear of the labels 41 carried by the bottles. The members 62 are generally circular in cross section and have a dimension which fits rather snugly over the shoulders of the bottles 31. As shown, the juxtaposed shoulder-engaging members 62 are joined together as shown in FIGS. 1 and 2 so as to provide two thicknesses of the molded material forming the members 62 and to thereby provide spaces 63 between the bottles whereby the bottles are spaced apart a predetermined distance so that labels 41 carried by the bottle clear each other and do not come in contact with each other to thereby prevent scuffing of the labels during shipment as hereinafter described. The shoulder-engaging members 62 are provided with cup-shaped portions 62*a* which as shown in FIG. 2 are provided with a cup-shaped curvature. The cup-shaped portions 62*a* adjoin tapered circular portions 62*b* and extend upwardly for the length of the necks 36 of the bottles and terminates generally at the top of the bottles. The shoulder-engaging members 62 as shown have openings 66 at the lowermost extremity of the cup-shaped portions 62*a* and openings 67 at the uppermost extremity of the tapered portion 62*b*. By providing the openings 67 this ensures that the shroud 61 when placed over the necks of the bottles 31 will travel downwardly over the shoulders 34 of the bottles 31.

In order to enhance the strength of the shroud 61, reinforcing portions 71 are provided in the interior of the shroud 61 between the exteriors of four adjacent shoulder-engaging members 62 and consists of upwardly and angularly inclined side walls 72 and 73 which adjoin along a line 76 on each of the four sides of each reinforcing portion 71. The lower extremities of the side walls 72 and 73 are formed integral with the lowermost extremities of the shoulder-engaging members 62. The upper extremities of the portions 72 and 73 are joined together by curved wall portions 77 to provide integral upstanding reinforcing portions 71 between each set of four shoulder-engaging members 62.

From the foregoing it can be seen that the shroud 61 is typically formed in a one piece integral construction with a plurality of shoulder-engaging members 62 adjoining each other in a desired geometrical arrangement as for example three rows of four in each row.

As can be seen, the shroud is provided with a generally hemispherical base which provides the cup-shaped portion for grasping the shoulder of the bottle. At the truncated conical extension of the hemispherical base, each shoulder-engaging member has generally the appearance of an upside-down ice cream cone. Although the shroud has been described with an open top which is particularly desirable to prevent scuffing of the closure for the bottle as for example the foil enclosing a champagne bottle, a closure can be provided when damage to a closure is not of concern as for example for packaging for beer bottles which have metal caps.

Operation and use of the shrouds 61 for providing packaging for bottles may now be briefly described as follows. Let it be assumed that the case 12 has been erected and the bottom platform or insert 51 has been placed therein and that thereafter, the bottles 31 either manually or by automatic packaging machinery have been placed into the case 12 with the bases 32 of the bottles being seated within the wells 52 of the bottom platform or insert 51 and thereby having their bases retained in spaced-apart positions to provide a predetermined spacing between the bases of the bottles 31. While the top of the case 12 is still open, the shroud 61 is placed over the tops and necks 36 of the bottles 31 until the shoulder-engaging members 62 come into frictional engagement with the shoulders 34 of the bottles to firmly engage the shoulders and to retain the shoulders of the bottles in predetermined positions to provide the spaces 63 between the bottles as hereinbefore described. The case can then be closed and is ready for shipment. During shipment, the shroud 61 serves to prevent the labels of the bottles from coming in contact with each other or with the side and end walls of the carton and with other labels to thereby prevent scuffing of the labels during shipment and transport of the bottles 31 from one location to another as for example from a winery to a distributor and thence from the distributor to a retailer.

Upon receipt of a case by a retailer or a customer, the case can be opened, the shroud 61 removed in one piece and thereafter, the bottles 31 removed in a conventional manner. The shroud 61 can be inexpensively manufactured from a molded pulp and can be readily used in conventional cases or containers for bottles. The shroud is formed in such a manner that will prevent scuffing of the labels. In addition since the shroud encloses the neck of the bottle it will also prevent scuffing of the closures for the bottle as for example when foil is used for example when foil is used for enclosing champagne corks. In other words it can be seen that with the construction utilized it can be seen that the shoulders and the bases of the bottles are grasped at non-labeled portions of the bottle to prevent label scuffing.

It is apparent from the foregoing that there has been provided new and novel packaging for bottles and a bottle neck shroud for use therewith which substantially eliminates label scuffing as well as scuffing of the closures on the necks of the bottles. The shrouds can be readily utilized either manually or with automatic packaging equipment.

What is claimed:

1. Packaging for a plurality of juxtaposed bottles with the bottles being of a type having a base, a body adjoining the base, the body having a shoulder and an upstanding neck adjoining the shoulder, a closure for the bottle mounted on the neck and a label adhered to the body of the bottle below the shoulder and above the base comprising a case in the form of a parallelepiped having spaced parallel side walls and spaced parallel end walls adjoining the side walls at right angles thereto and spaced-apart top and bottom closures adjoining the side and end walls at right angles thereto, a shroud engaging the shoulders of the bottles and extending upwardly over the the closures for the bottles, said shroud retaining the bottles in spaced-apart positions with respect to each other to prevent the labels of the bottles from coming into contact with each other and with the side and end walls of the case and protecting the closures for the bottles, said shroud comprising a plurality of cup-shaped shoulder-engaging members circumscribing the shoulders of all the bottles and being formed integral with each other and extending onto the shoulders of the bottles to retain the bodies of the bottles in spaced-apart positions with respect to each other and the side and end walls of the case and to retain the shoulder-engaging members in positions spaced above the labels of the bottles, said shrouds resting on the bottles and being free of the bottles to permit lifting of the shroud off of the bottles.

2. Packaging as in claim 1 wherein said shroud includes a plurality of neck-receiving portions adjoining the shoulder-engaging members and being sized to receive the necks of the juxtaposed bottles.

3. Packaging as in claim 1 wherein said shroud is formed of a molded pulp.

4. Packaging as in claim 2 wherein said neck-receiving portions have open ends.

5. Packaging as in claim 2 wherein said neck-receiving portions have closed ends.

6. Packaging as in claim 4 wherein the neck-receiving portions are sized to remain out of contact with the closures.

7. Packaging as in claim 2 wherein said neck-receiving portions are in the form of a truncated cone.

8. Packaging as in claim 1 wherein said shroud includes raised reinforcing portions disposed between four adjacent cup-shaped shoulder-engaging members.

9. Packaging as in claim 1 further including a bottom platform disposed on the bottom of the case against the bottom closure and having a plurality of spaced-apart wells therein for receiving the bases of the plurality of juxtaposed bottles for retaining the bases of the juxtaposed bottles in spaced-apart positions and cooperating with the shroud to retain the bodies of the bottles in spaced-apart positions with respect to each other and the side and end walls of the case.

10. A shroud for use in packaging bottles of the type having a base, a body adjoining the base, the body having a shoulder at its upper extremity and a neck adjoining the shoulder, a closure for the bottle mounted on the neck and a label adhered to the body of the bottle below the shoulder and above the base comprising a plurality of cup-shaped shoulder-engaging members, said cup-shaped shoulder-engaging members being adapted to seat on the shoulders of the bottles and circumscribe the shoulders of all the bottles to retain the shoulder-engaging members in a position above the labels of the bottles, the shroud including means interconnecting the shoulder-engaging members for retaining the shoulder-engaging members in spaced-apart positions with respect to each other and adapted to prevent the bodies of juxtaposed bottles from coming into contact with each other to thereby prevent scuffing of the labels during shipment of the bottles, said shroud being adapted to be free of the bottles so that the shroud can be readily placed on the bottles and removed from the bottles, said shroud begin adapted to extend above the closures for the bottles when the cup-shaped members are seated on the shoulders of the bottles to protect the closures of the bottles.

11. A shroud as in claim 10 wherein each of said shoulder-engaging members includes a neck-receiving portion adjoining the shoulder-engaging member and being sized to receive the necks of the bottles and the closures for the bottles.

12. A shroud as in claim 10 wherein said means interconnecting the shoulder-engaging members includes upstanding reinforcing portions disposed between the shoulder-engaging members.

13. A shroud as in claim 11 wherein the neck-receiving portions have open ends.

14. A shroud as in claim 11 wherein said neck-receiving portions have closed ends.

15. A shroud as in claim 11 wherein said neck-receiving portion is in the form of a truncated cone.

* * * * *